United States Patent [19]

Yabuki et al.

[11] 4,088,179

[45] May 9, 1978

[54] COOLING GUIDE SYSTEM FOR CONTINUOUS CASTING MACHINE

[75] Inventors: Takashi Yabuki; Naohiro Shidara; Tomoaki Kimura, all of Hitachi, Japan

[73] Assignee: Hitachi, Ltd., Tokyo, Japan

[21] Appl. No.: 670,246

[22] Filed: Mar. 25, 1976

[30] Foreign Application Priority Data

Apr. 21, 1975 Japan ..... 50-47439

[51] Int. Cl.[2] ..... B22D 11/24; B22D 11/124

[52] U.S. Cl. ..... 164/441; 164/444

[58] Field of Search ..... 164/273 M, 281, 282, 164/273 R, 283, 283 S, 283 MS, 348

[56] References Cited

U.S. PATENT DOCUMENTS

| | | | |
|---|---|---|---|
| 2,770,021 | 11/1956 | Harter | 164/282 X |
| 3,015,862 | 1/1962 | Rustemeyer | 164/283 S |
| 3,391,725 | 7/1968 | Rossi | 164/89 |
| 3,393,727 | 7/1968 | Rys | 164/282 |
| 3,437,129 | 4/1969 | Black | 164/282 |
| 3,662,813 | 5/1972 | Stull | 164/273 R |
| 3,726,336 | 4/1973 | Moritz | 164/89 X |
| 3,800,855 | 4/1974 | Bashkov | 164/283 S |
| 3,882,924 | 5/1975 | Fujikawa | 164/283 R |

FOREIGN PATENT DOCUMENTS

| | | | |
|---|---|---|---|
| 382,462 | 5/1973 | U.S.S.R. | 164/282 |

*Primary Examiner*—Francis S. Husar
*Assistant Examiner*—John S. Brown
*Attorney, Agent, or Firm*—Beall & Jeffery

[57] ABSTRACT

A continuous casting machine comprising a tundish for pouring molten metal to be cast into a mould, a mould for cooling the supplied molten metal into a billet in a semi-solidified state to be withdrawn downward, and a cooling guide provided immediately beneath the mould and promoting the cooling of the billet emerging from the mould, said cooling guide consisting of cooling guide blocks each urged against each corner of the billet via a spring and having cooling medium intervening between each block and corresponding billet corner.

12 Claims, 5 Drawing Figures

COOLING GUIDE SYSTEM FOR CONTINUOUS CASTING MACHINE

BACKGROUND OF THE INVENTION

This invention relates to continuous casting machines and, more particularly, to a continuous casting machine provided with a cooling guide disposed immediately beneath the mould for the purpose of preventing break-out of the billet as it is withdrawn from the mould.

In the recent continuous casting machines, increase of the casting speed is called for in order to better the productivity. In order to realize high-speed casting, however, the billet has to be cooled down uniformly and quickly to form a thick shell capable of withstanding the high speed casting. In addition, it is necessary to provide means for preventing the rupture of the outer shell or so-called "break-out" with the inner mold flowing out through the broken shell. As one measure against this break-out, provision of the so-called cooling guide, which is a cooling jacket or the like disposed immediately beneath the mould and vertically oscillated in synchronism to the mould, has been adopted in place of spray cooling which has been the usual cooling method. For example, in a "high-speed cast billet support means" disclosed in the Japanese Unexamined Published Patent Application No. 40632/1973 a cooling jacket is urged against each side of the billet to cool the billet. This type of cooling guide, however, has its main aim in the cooling of the four flat sides of the billet, and the corners of the billet are cooled by merely jetting cooling water from water sprays. However, the inventors have found from their experience that the majority of break-outs take place at the corners of the billet immediately beneath the mould, so that the disclosed invention is set not much apart from the conventional spray cooling in so far as the prevention of break-out at the billet corner is concerned.

SUMMARY OF THE INVENTION

An object of the invention is to provide a continuous casting machine provided with a novel guide means, which can preclude the drawbacks inherent in the prior-art cooling guide for continuous casting and prevent break-outs that might otherwise occur most frequently at the corners of the billet.

The above object of the invention is achieved by a continuous casting machine, the cooling guide of which consists of a plurality of cooling support blocks adapted to cover the respective corners of the billet immediately beneath the mould, thereby promoting the cooling of the corners of the billet.

Further, in order to achieve enhanced cooling effect on the corners of the billet a cooling medium channel or path is formed between each block and corresponding billet surface for causing flow of the cooling medium along said corresponding billet surface. For doing so the block is provided with inner cooling medium passages open to the respective channels facing the corresponding billet corner.

Meanwhile, it is desirable to additionally cool the flat portions of the billet in the usual manner, for instance by spraying cooling water or by using a cooling guide for the flat portions. However, it is important to provide less cooling capacity for the flat portions than that for the corners. With such arrangement according to the invention, it is possible to achieve prompt formation of a shell of the billet being withdrawn from the mould, particularly at the corners of the billet most prone to the break-out, thus permitting to set an increased speed of withdrawal of the billet.

BRIEF DESCRIPTION OF THE INVENTION

DETAILED DESCRIPTION OF THE PREFERRED EMBODIMENT

Figure 1:
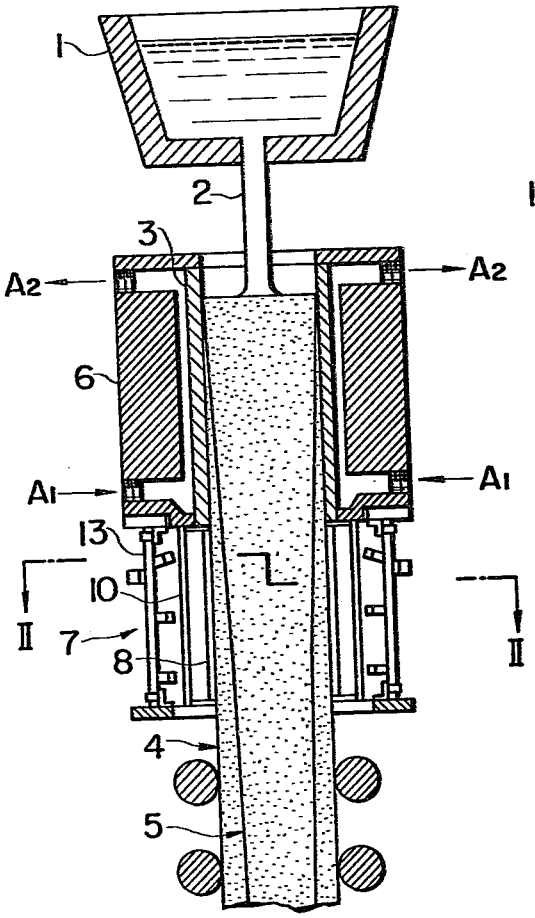
FIG. 1 is a longitudinal sectional view of an embodiment of the continuous casting machine according to the invention in operation.
Figure 2:
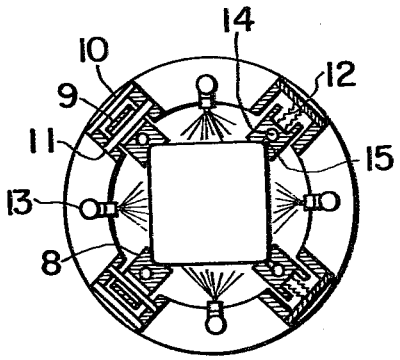
FIG. 2 is a sectional view taken along line II-II in FIG. 1.

A preferred embodiment of the invention will now be described with reference to the drawing.

Referring now to FIG. 1, as molten metal 2 is continuously poured from a turndish 1 into a vertically oscillating mould 3, the resultant billet 4 is continuously withdrawn downward. A shell 5 formed within the mould 3 from the mold in contact therewith increases its thickness as it proceeds downward, but liquid metal is still confined within the billet 4. The mould 3 is cooled by cooling water introduced in the direction of arrow $A_1$ and exhausted in the direction of arrow $A_2$. The mold 3 is also secured to a mould cartridge 6, which has the cooling water passage and is mounted on an oscillable table (not shown) for vertical oscillation. As the billet 4 is cooled down by cooling water, it is continuously withdrawn downward by withdrawal means such as pinch rollers disposed below the mould while progressively increasing the thickness of its outer shell 5.

According to the invention, a cooling guide means 7 is provided immediately beneath the mould 3 and consists of a plurality of cooling support blocks 8 each supported for horizontal movement by pins 11 extending through slots 9 formed in the block and in a support frame 10 coupled to the mould 3. Also, each cooling support block 8 is urged against the billet 4 by compression springs 12 provided within the support frame 10. Thus, the cooling support block 8 can follow contraction of the billet 4 through solidification or sectional area change thereof and be always held in contact with the billet 4, thus promoting the cooling of the billet 4 to promote solidification of the non-solidified metal remaining within the billet 4. In this way, break-out at the corner of the billet can be prevented.

According to the invention, liquid sprays 13 are also provided for the flat portions of the billet 4. Thus, both flat portions and corners of the billet 4 are cooled to ensure perfect prevention of the break-out.

The cooling of the billet by the billet cooling guide according to the invention will now be described. The bottom of each cooling support block 8 is provided with an inlet for a cooling medium, preferably water, and a cooling water passage 14 extends upwardly from the inlet through the cooling support block 8, with the top of the passage closed liquid-tight. A plurality of small passages 15 branch from the passage 14 at suitable vertical positions thereof and communicate with the billet surface. In other words, cooling water entering the block from the cooling water inlet is forced through the passages 14 and 15 and issued against the surface of the billet 4. More specifically, each small passage 15 is open at the outlet end to a small groove 16, where the dynamic pressure of the cooling water is converted into static pressure so as to uniformly cool the portion of the billet 4 in contact with the cooling support block 8. In operation, a small gap is formed between each cooling support block 8 and billet 4 so that the cooling water can flow through the gap at a high speed. Besides, this high-speed cooling water is directly supplied to the billet 4 for cooling thereof through the passage 14 and small passages 15. Thus, the billet cooling guide according to the invention can provide a cooling capacity 4 to 5 times that of the afore-mentioned indirect cooling system disclosed in the Japanese Unexamined Published Patent Application 40632/1973. Moreover, since the flat portions of the billet 4 are cooled by the conventional water spray system, both the corners and flat portions can be uniformly cooled to perfectly eliminate the break-out.

Figure 3:
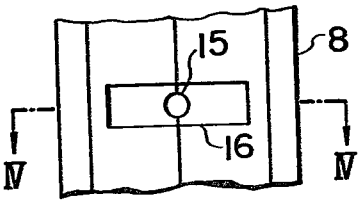
FIG. 3 is a front view showing the form of a cooling water groove formed in a billet cooling support block according to the invention such as to face the surface of a billet corner.
Figure 4:
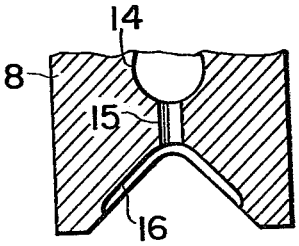
FIG. 4 is a sectional view taken along line IV-IV in FIG. 3.
Figure 5:
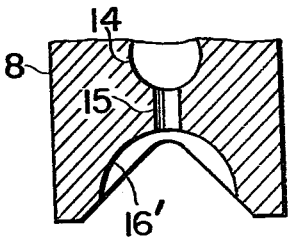
FIG. 5 is a view similar to FIG. 4 but showing a different form of the cooling water groove; like reference numerals in the Figures designating like parts.

FIG. 5 shows an alternative form of the groove 16' in the cooling support block shown in FIGS. 3 and 4. In this example, the groove has a circular sectional profile, and this shape requires only a signal groove cutter and a single arrangement for cutting, thus permitting to reduce the number of processing steps to the advantage.

The cooling guide according to the invention may incorporate means for cooling the flat portions of the billet in the form of cooling jacket sprays as has been mentioned earlier as prior-art examples. In this case, it is important that the cooling capacity for the flat portions is less than that for the corners. This is achieved by reducing the sectional area of the cooling water passage for the flat portions so as to reduce the cooling water supply rate therefor. Such a cooling guide may be constructed with four guides of an L-shaped sectional profile capable of cooling both corner and flat portions simultaneously. In this case, each L-shaped guide may be formed with grooves, which are deep in a portion corresponding to the corner of the billet and become progressively shallower toward the flat portions of the billet.

Since in the continuous casting machine according to the invention a plurality of cooling support blocks suspended and capable of horizontal movement independently of one another are disposed to face the respective corners of the billet, break-outs at the corners of the billet, which have heretofore constituted 60 to 80% of the break-outs occurring in the billet immediately beneath the mould, can be prevented practically perfectly.

In addition, the invention has the following supplementary effects:

(a) Since the cooling support blocks are urged against the billet by flexible members such as springs, they can follow contraction and sectional area change of the billet and can thus maintain constant cooling effect.

(b) Since each of the cooling support blocks is formed with a plurality of small cooling water passages branching from the main passage as suitable vertical positions thereof and open to the billet surface, the corners of the billet can be directly cooled with high-speed cooling water to achieve cooling effect comparable to or greater than that of the prior-art spray cooling, whereby break-outs that are otherwise likely to result at the corners of the billet can be perfectly prevented.

We claim:

1. A continuous casting machine, comprising: means for pouring molten metal to be cast into a mould; mould means disposed below said pouring means for cooling the molten metal supplied from above into a polygonal billet having corners and flat sides between the corners, and for discharging the billet to be withdrawn downwardly; and cooling guide means provided immediately beneath said mould means and serving to promote the cooling of said billet emerging from said mould, said cooling guide means including a plurality of elongated cooling support block means for covering and facing, respectively, the entire corners over a substantial length of said billet, and each of said cooling support block means providing coolant flow passages open to the billet corners to cool the billet corners more effectively than the flat sides.

2. The continuous casting machine according to claim 1, wherein said cooling guide means includes fluid spray means for spraying a cooling medium onto flat surface portions of said billet flat sides between adjacent corners of said billet and between said cooling support block means.

3. The continuous casting machine according to claim 2, wherein said cooling guide means includes a frame mounting said plurality of cooling support block means for movement toward and away from the billet, and biasing means interposed between said frame and respective ones of said cooling support block means, for biasing said cooling support block means against the billet.

4. The continuous casting machine according to claim 3, wherein each of said cooling support block means includes cooling passage means having an inlet for receiving a cooling fluid and having an outlet at the respective corner of the billet opening into said coolant flow passages for contacting the cooling fluid with the billet.

5. The continuous casting machine according to claim 4, wherein said coolant passages face and cover substantially the entire adjacent billet corner so as to provide with the closely adjacent billet an enlarged cooling fluid receiving chamber having leakage between the closely adjacent portions of said cooling support block means and the billet.

6. The continuous casting machine according to claim 2, wherein each of said cooling support block means includes cooling passage means having an inlet for receiving a cooling fluid and having an outlet at the respective corner of the billet opening into said coolant flow passages for contacting the cooling fluid with the billet.

7. The continuous casting machine according to claim 6, wherein said coolant passages face and cover substantially the entire adjacent billet corner so as to provide with the closely adjacent billet an enlarged cooling fluid receiving chamber having leakage between the closely adjacent portions of said cooling support block means and the billet.

8. The continuous casting machine according to claim 1, wherein said cooling guide means includes a frame mounting said plurality of cooling support block means for movement toward and away from the billet, and biasing means interposed between said frame and respective ones of said cooling support block means, for biasing said cooling support block means against the billet.

9. The continuous casting machine according to claim 8, wherein each of said cooling support block means includes cooling passage means having an inlet for receiving a cooling fluid and having an outlet at the respective corner of the billet opening into said coolant flow passages for contacting the cooling fluid with the billet.

10. The continuous casting machine according to claim 9, wherein said coolant passages face and cover substantially the entire adjacent billet corner so as to provide with the closely adjacent billet an enlarged cooling fluid receiving chamber having leakage between the closely adjacent portions of said cooling support block means and the billet.

11. The continuous casting machine according to claim 1, wherein each of said cooling support block means includes cooling passage means having an inlet for receiving a cooling fluid and having an outlet at the respective corner of the billet opening into said coolant flow passages for contacting the cooling fluid with the billet.

12. The continuous casting machine according to claim 11, wherein said coolant passages face and cover substantially the entire adjacent billet corner so as to provide with the closely adjacent billet an enlarged cooling fluid receiving chamber having leakage between the closely adjacent portions of said cooling support block means and the billet.

* * * * *